US007836923B2

(12) United States Patent
Stager

(10) Patent No.: US 7,836,923 B2
(45) Date of Patent: Nov. 23, 2010

(54) RING SLICER WITH EASILY REMOVABLE KNIFE AND KNIFE ASSEMBLY

(75) Inventor: Bradley R. Stager, Beaverton, OR (US)

(73) Assignee: Key Knife, Inc., Tualatin, OR (US)

( * ) Notice: Subject to any disclaimer, the term of this patent is extended or adjusted under 35 U.S.C. 154(b) by 266 days.

(21) Appl. No.: 10/789,268

(22) Filed: Feb. 26, 2004

(65) Prior Publication Data

US 2004/0168745 A1 Sep. 2, 2004

Related U.S. Application Data

(63) Continuation-in-part of application No. 10/280,278, filed on Oct. 25, 2002, now Pat. No. 6,757,952.

(51) Int. Cl.
*B27C 1/00* (2006.01)

(52) U.S. Cl. ..... 144/162.1; 144/176; 144/218; 144/230; 407/47; 407/111

(58) Field of Classification Search ..... 144/174, 144/176, 218, 230, 241, 175, 162.1, 172, 144/373; 241/92, 93, 95, 298, 294; 407/47, 407/49, 107, 111
See application file for complete search history.

(56) References Cited

U.S. PATENT DOCUMENTS 2,849,038 A * 8/1958 Clark ..... 144/172
3,189,066 A * 6/1965 Linares et al. ..... 144/172
3,209,801 A * 10/1965 Little et al. ..... 144/172
3,322,175 A * 5/1967 Ward ..... 241/282.2
3,559,705 A * 2/1971 Salzmann, Jr. ..... 144/162.1
3,661,192 A * 5/1972 Nicholson et al. ..... 144/176
3,865,164 A 2/1975 Sybertz
3,904,139 A * 9/1975 Maier et al. ..... 241/286
3,989,077 A 11/1976 Humbert
4,000,860 A * 1/1977 Gotham ..... 241/242

(Continued)

FOREIGN PATENT DOCUMENTS

DE 11 99 477 B 8/1965

(Continued)

OTHER PUBLICATIONS

European Search Report, European Patent Application No. EP 03 25 6191 (European Patent No. 1,413,310A granted Apr. 28, 2004) dated Jun. 10, 2004, EPO Communication dated Jun. 25, 2004.

(Continued)

*Primary Examiner*—Bena Miller
(74) *Attorney, Agent, or Firm*—Portland Intellectual Property, LLC

(57) ABSTRACT

A ring slicer with easily removable knife and knife assembly. According to one aspect of the invention, a ring assembly comprises two end plates for rotation about an axis of rotation. Each of the knife assemblies comprises an elongate knife having a cutting edge extending along an elongate axis, a base, and a clamp for clamping the knife to the base. The knife assemblies are adapted for installation between the end plates such that the shoulder portions of at least two shoulder bolts extend through one of the end plates into the base.

18 Claims, 7 Drawing Sheets

U.S. PATENT DOCUMENTS

| | | | | | |
|---|---|---|---|---|---|
| 4,135,563 | A | | 1/1979 | Maucher | |
| 4,139,034 | A | * | 2/1979 | Chapman | 144/172 |
| 4,194,545 | A | | 3/1980 | Kostermeier | |
| 4,347,882 | A | * | 9/1982 | Bachmann | 144/225 |
| 4,470,442 | A | | 9/1984 | Krautzberger et al. | |
| 4,503,893 | A | * | 3/1985 | Demopoulos | 144/176 |
| 4,614,309 | A | * | 9/1986 | Goldenberg | 241/163 |
| 4,709,607 | A | * | 12/1987 | Buhayar | 83/342 |
| 4,754,789 | A | * | 7/1988 | Jonsson | 144/241 |
| 4,887,772 | A | * | 12/1989 | Robinson et al. | 241/92 |
| 4,972,888 | A | * | 11/1990 | Dean | 144/172 |
| 5,129,437 | A | * | 7/1992 | Nettles et al. | 144/176 |
| 5,217,424 | A | | 6/1993 | Pallmann | |
| 5,271,440 | A | * | 12/1993 | Bradstreet et al. | 144/176 |
| 5,271,442 | A | | 12/1993 | Carpenter | |
| 5,287,901 | A | * | 2/1994 | Matthews | 144/176 |
| 5,313,696 | A | | 5/1994 | Dunne et al. | |
| 5,348,064 | A | * | 9/1994 | Nettles et al. | 144/176 |
| 5,444,904 | A | | 8/1995 | Kokko | |
| 5,456,300 | A | | 10/1995 | Rosencranz et al. | |
| 5,469,902 | A | * | 11/1995 | Sharp et al. | 144/241 |
| 5,485,873 | A | * | 1/1996 | Crammond | 144/162.1 |
| 5,544,826 | A | * | 8/1996 | Klingler et al. | 241/242 |
| 5,655,582 | A | * | 8/1997 | Morin | 144/176 |
| 5,725,464 | A | | 3/1998 | Pallmann | |
| 5,816,303 | A | | 10/1998 | Shadeck et al. | |
| 5,819,826 | A | * | 10/1998 | Schmatjen | 144/241 |
| 5,820,042 | A | * | 10/1998 | Robison | 241/92 |
| 5,937,923 | A | * | 8/1999 | Bielagus et al. | 144/172 |
| 5,979,522 | A | * | 11/1999 | Swartwood et al. | 144/176 |
| 5,983,769 | A | * | 11/1999 | Schneider | 83/865 |
| 5,996,655 | A | | 12/1999 | Cramond et al. | |
| 6,058,989 | A | | 5/2000 | LaGrange et al. | |
| 6,263,775 | B1 | * | 7/2001 | Vossing et al. | 83/698.51 |
| 6,554,032 | B2 | | 4/2003 | Pallmann | |
| 6,561,885 | B1 | * | 5/2003 | Loth | 451/122 |
| 6,591,878 | B2 | | 7/2003 | Hinchliff | |
| 6,662,837 | B2 | * | 12/2003 | Smith | 144/241 |
| 6,757,952 | B1 | * | 7/2004 | Stager | 29/402.03 |
| 6,854,676 | B2 | * | 2/2005 | Dubech et al. | 241/236 |

FOREIGN PATENT DOCUMENTS

| | | | |
|---|---|---|---|
| DE | 1214862 | | 4/1966 |
| DE | 19 26 777 | | 11/1970 |
| DE | 1653122 | | 11/1971 |
| DE | 76 09 913 | U1 | 7/1976 |
| DE | 35 17 236 | A1 | 11/1986 |
| DE | 199 17 645 | A1 | 10/2000 |
| EP | 0 990 494 | A | 4/2000 |
| EP | 1 329 295 | A2 | 1/2003 |
| EP | 1 413 410 | A | 4/2004 |
| EP | 1568453 | | 4/2005 |

OTHER PUBLICATIONS

European Search Report, European Patent Application No. EP 05002443.9 (European patent No. 1,413,310A granted Apr. 13, 2005) dated Apr. 13, 2005, EO Communication dated Apr. 29, 2005.

* cited by examiner

Fig. 1
(PRIOR ART)
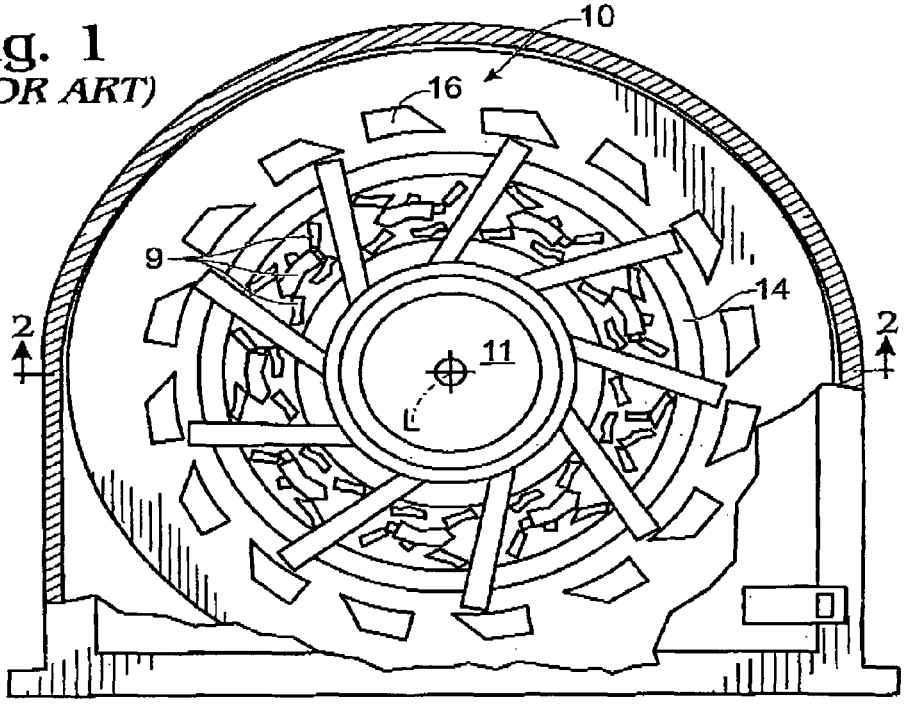
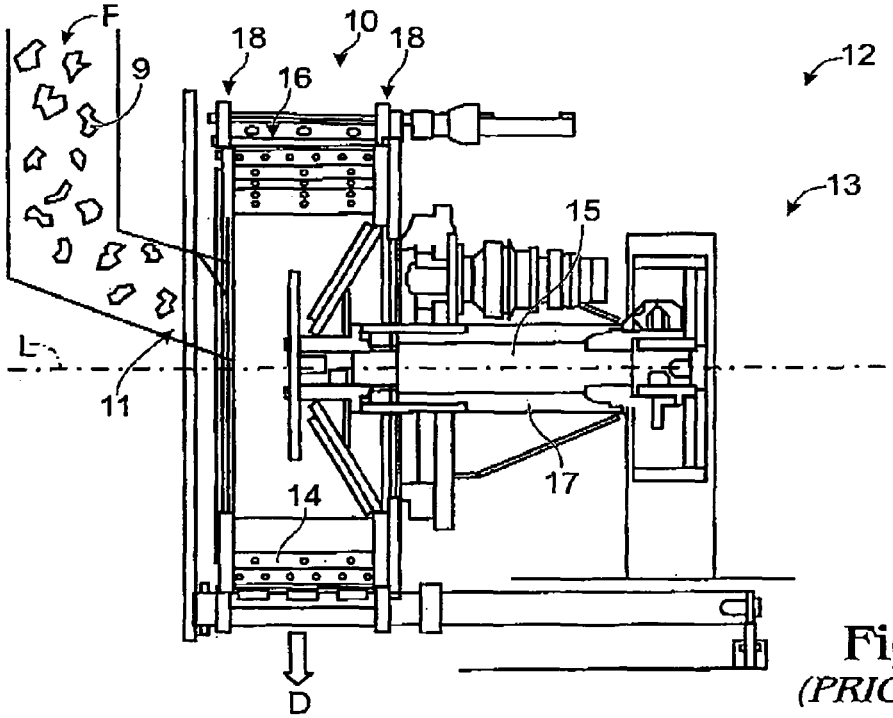
Fig. 2
(PRIOR ART)

RING SLICER WITH EASILY REMOVABLE KNIFE AND KNIFE ASSEMBLY

RELATED APPLICATION

This is a continuation-in-part of U.S. No. 10/280,278, filed Oct. 25, 2002, now U.S. Pat. No. 6,757,952.

FIELD OF INVENTION

The present invention relates to a ring slicer having an easily removable knife and knife assembly, particularly for use in slicing or flaking logs, refuse lumber, chips, or other articles of wood in a lumber mill.

BACKGROUND OF THE INVENTION

Ring slicers, also termed ring flakers or stranders, are generally used in manufacturing facilities for manufacturing particle board, oriented strand board, and fiberboard such as MDF. They convert logs, refuse lumber, chips, or other articles of wood into flakes, wafers or strands for the manufactured board products. The ring slicer includes a cylindrical ring assembly for revolution about an axis of rotation. The ring assembly typically includes a large number of elongate knife assemblies, commonly 49 but which may be as many as 72. The knife assemblies support elongate knives having cutting edges extending parallel to the axis of rotation captured between annular end plates. The ring assembly rotates within a chamber into which pieces of wood to be cut or chipped are introduced.

The knives are subject to wear from the wood, and in addition rocks, metal objects and other hard foreign material carried by or with the wood also wear the knives, and may damage or break the knives as well as the knife assemblies. Accordingly, it is routinely required to remove the knives to repair or replace them, or to turn them to expose fresh cutting edges. Moreover, it is episodically required to remove and replace some or all of the knives, the knife assemblies, or both, as a result of "crashes" of the ring slicer apparatus. The machine downtime and the labor required to effect maintenance and repair are costly and desirably kept to a bare minimum.

As described in U.S. Pat. No. 5,313,696, the knives may be mounted to a portable knife assembly that slides radially into slots in the end plates of the ring assembly. Once in place, bolts are inserted through holes in the end plates into threaded holes in the knife assembly to hold the knife assembly in place. In turn, the knife is similarly mounted to the knife assembly with bolts extending through holes in the knife into threaded holes in the knife assembly.

One problem with this approach is that the bolt holes require a tolerance that permits the knife or knife assemblies to move or creep within the ring assembly and thereby to become misaligned or to loosen as a result of the large cutting forces encountered during operation. Moreover, removing the knife from the ring slicer requires both removing the knife assembly from the ring assembly and removing the knife from the knife assembly.

To hold the knife assembly more securely to the ring assembly, the knife assembly may be provided with protruding keys that extend axially into corresponding keyholes in the end plates. The keys and keyholes can be provided with a minimal tolerance of fit that maintains the positional integrity of the knife assembly. However, a major disadvantage of this approach is that the knife assemblies may no longer be simply slid radially away from the ring assembly for maintenance or repair. Rather, the end plates must be axially spaced apart a sufficient amount to permit the projecting keys to clear the end plates, requiring that the entirety of at least one end plate be decoupled from all of the knife assemblies.

It is often necessary to remove a knife from the knife assembly under conditions where it is not otherwise necessary to remove the knife assembly from the ring assembly. U.S. Pat. No. 5,937,923 addresses this problem by providing a clamp for the knife that is biased outwardly by springs disposed in spring holes in the knife assembly, for unclamping the knife without requiring removal of the clamping bolts.

A disadvantage of the mechanism is that it requires the clamp to move radially, and while a necessary indexing of the clamp is provided to seat the clamp into proper position when it is tightened, this is provided in the form of sliding surfaces that wear over time so that the position of the clamp and, therefore, the knife are permitted to wander. Another disadvantage of the mechanism is that it is difficult to remove cut wood fibers introduced into the spring holes when the clamp is loosened. It is yet another disadvantage of the mechanism that the spring forces produced by the multiple compression springs must be well matched to prevent binding of the clamp.

Accordingly, there is a need for a ring slicer having an easily removable knife and knife assembly that provides for positive maintenance of the position of the knife in the ring slicer as well as easy removal of the knife and knife assembly therefrom.

SUMMARY OF THE INVENTION

The invention disclosed herein is a ring slicer having an easily removable knife and knife assembly. According to one aspect of the invention, there is an assembly for clamping a knife, the knife having two sides, the assembly comprising a base and a clamp for clamping the knife to the base. The clamp includes an upper clamping member for mounting to the base so that a portion of the upper clamping member is cantilevered from the base. The upper clamping member includes provision for at least one bolt extending through the portion into the base such that tightening the bolt elastically deflects the upper clamping member against one side of the knife.

According to another aspect of the invention, there is an assembly for clamping a knife, comprising a base and a clamp. The clamp includes an upper clamping member for mounting to the base and a wearshoe for separately mounting to the base. The clamp is adapted for clamping the knife between the upper clamping member and the wearshoe. The wearshoe and the base include cooperatively interlocking portions adapted to resist relative motion between the wearshoe and the base in a first direction. Alternatively or in addition, the wearshoe and the base include cooperatively ramping portions adapted to resist relative motion between the wearshoe and the base in one direction.

According to yet another aspect of the invention, there is an apparatus for cutting an article of wood, comprising a ring assembly and a plurality of knife assemblies. The ring assembly comprises two end plates for rotation about an axis of rotation. Each of the knife assemblies comprises an elongate knife having a cutting edge extending along an elongate axis, a base, and a clamp for clamping the knife to the base. The knife assemblies are adapted for installation between the end plates such that the shoulder portions of at least two shoulder bolts extend through one of the end plates into the base. Preferably the knife has dual cutting edges.

BRIEF DESCRIPTION OF THE DRAWINGS

FIG. 1 is a front, partially cut-away view of a prior art ring slicer.

FIG. 2 is a plan, section view of the ring slicer of FIG. 1, taken along a line 2-2 thereof.

DETAILED DESCRIPTION OF A PREFERRED EMBODIMENT

Figure 3:
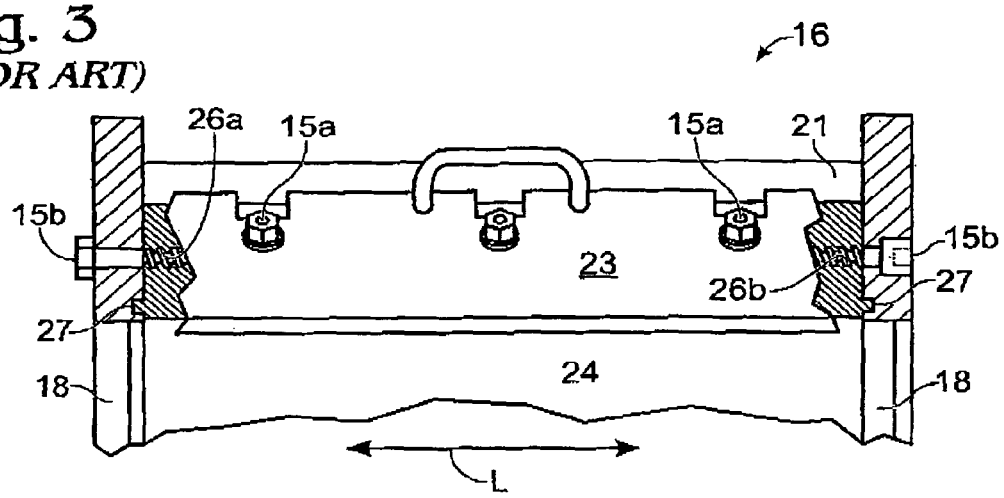
Fig. 3 (PRIOR ART)
FIG. 3 is a partially cut-away, elevational view of a prior art knife assembly for the ring slicer of FIGS. 1 and 2.

Referring to FIGS. 1 and 2, a prior art ring slicer 12 is shown, such as disclosed in U.S. Pat. No. 5,937,923. The ring slicer has a ring assembly 10 that is caused to rotate about an axis of rotation "L." The ring assembly 10 has a number of cutting knife assemblies 16 for cutting and chipping pieces of wood 9 that flow in the direction indicated as "F" in FIG. 2) into the apparatus through an opening 11. The ring slicer also includes a "rotor" 14 that counter-rotates with respect to the ring assembly 10 about the axis "L," to sling the pieces of wood 9 against the knives of the ring assembly. A drive mechanism 13 includes respective motors (not shown) for driving the rotor through an arbor shaft 15 and for driving the ring assembly 10 through a coaxially disposed drive-shaft 16. The knife assemblies 16 are captured between two annular rings 18 (not shown in FIG. 1).

The ring slicer 12 is particularly adapted to manufacture particle board; however, with suitable adaptation the ring slicer may be used to manufacture oriented strand board as well. While either of these are preferred contexts for the present invention, the principles of the invention may be applied to any cutting apparatus, particularly any cutting apparatus for processing articles of wood.

Turning to FIG. 3, a prior art knife assembly 16 is shown, captured between the two annular rings 18 of the ring assembly shown in FIG. 2. The knife assembly 16 has an elongate body 21 to which is directly bolted, by use of bolts 15*a*, an elongate knife 23 having a cutting edge 24. The body includes threaded holes at ends 26*a*, 26*b* thereof for bolting the body between the rings 18 by use of bolts 15*b*. The body also includes respective projecting keys 27 at the ends for extending into mating keyholes in the rings, the reversal of the keys and keyholes being functionally equivalent. While the bolts 15 hold the ring assembly together, the keys and keyholes are used to locate the knife assemblies with respect to the rings and thereby prevent creep of the knife assembly resulting in misalignment during use. A similar strategy could be used to key the knife 23 to the body 21.

To remove the knife 23 from the knife assembly 16 when it is installed between the rings 18 requires complete removal of all of the bolts 15*a* of the knife assembly. To remove the knife assembly 16 from the ring assembly 10 requires removing the bolts 15*b*, and moving the rings 18 axially far enough apart so that the projecting keys 27 clear the inside faces 29 of the rings 18 so that the knife assembly can be slid outwardly from the ring assembly. This latter step requires at least loosening and typically completely removing the bolts 15*b* for every knife assembly in the ring assembly. Where there are typically 49 or as many as 72 knife assemblies in the ring assembly, this is an objectionably laborious and time consuming process.

Figure 4:
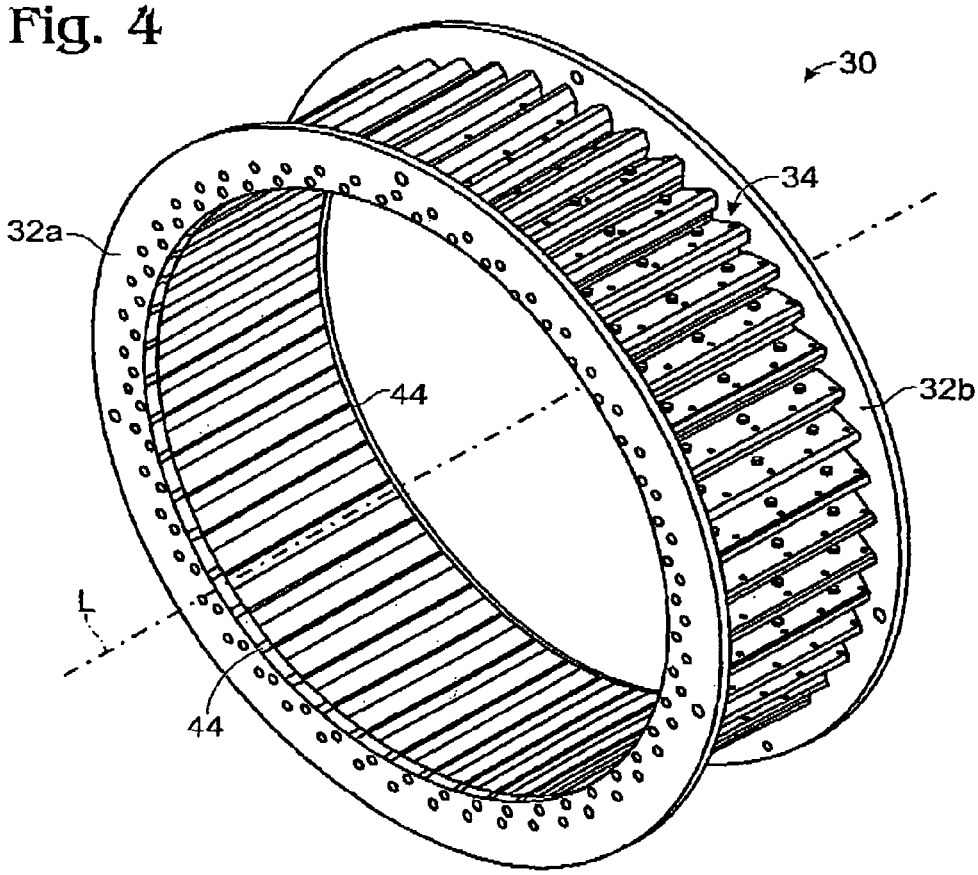
FIG. 4 is a pictorial view of a ring assembly according to the present invention.

Turning to FIG. 4, a ring assembly 30 according to the present invention is shown that substantially reduces the time and labor required to change either the knives of the knife assemblies, or the knife assemblies themselves.

The ring assembly 30 includes two end plates 32*a*, 32*b* which are preferably but not necessarily annular in shape. Captured between the two end plates 32 are a plurality of individual knife assemblies 34. There are typically 49 knife assemblies, but the number of knife assemblies may vary considerably. For example, ring slicers are available with as few as 32 knife assemblies and as many as 72 knife assemblies.

Figure 5:
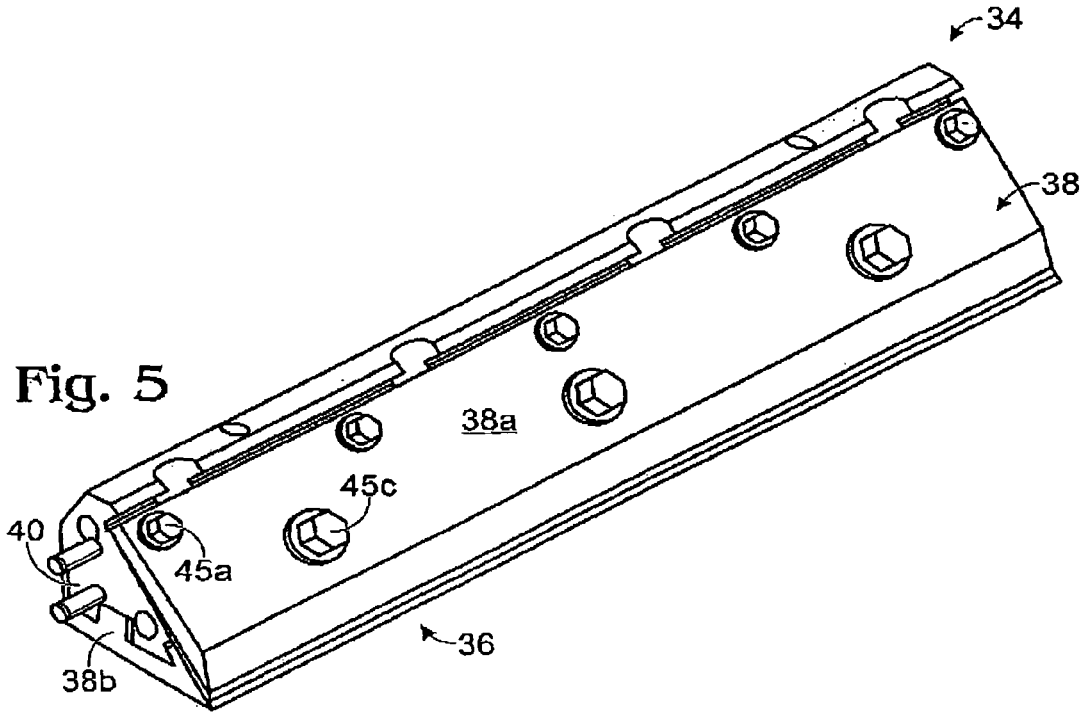
FIG. 5 is a pictorial view of a knife assembly according to the present invention.
Figure 6:
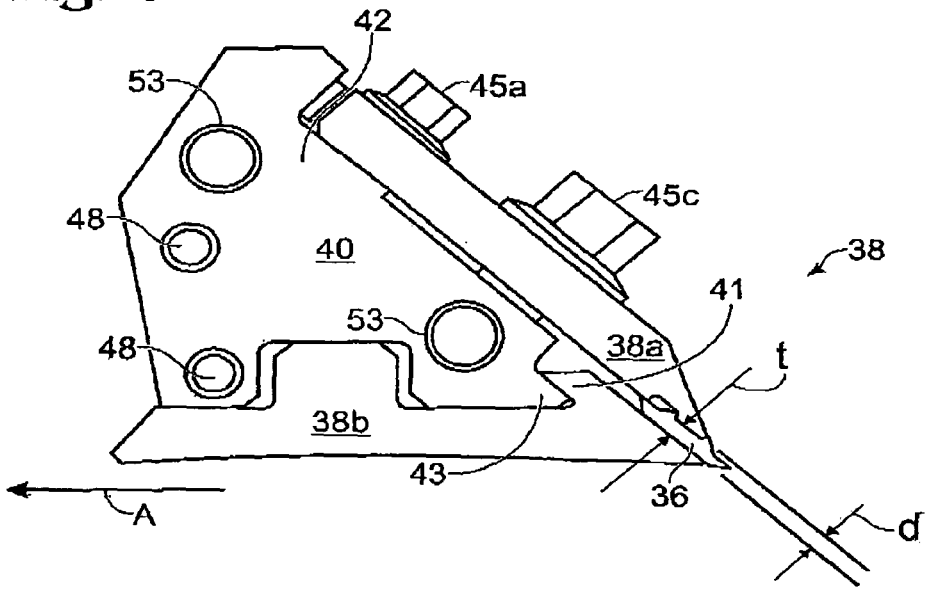
FIG. 6 is an end view of the knife assembly of FIG. 5.
Figures 7, 10, 12:
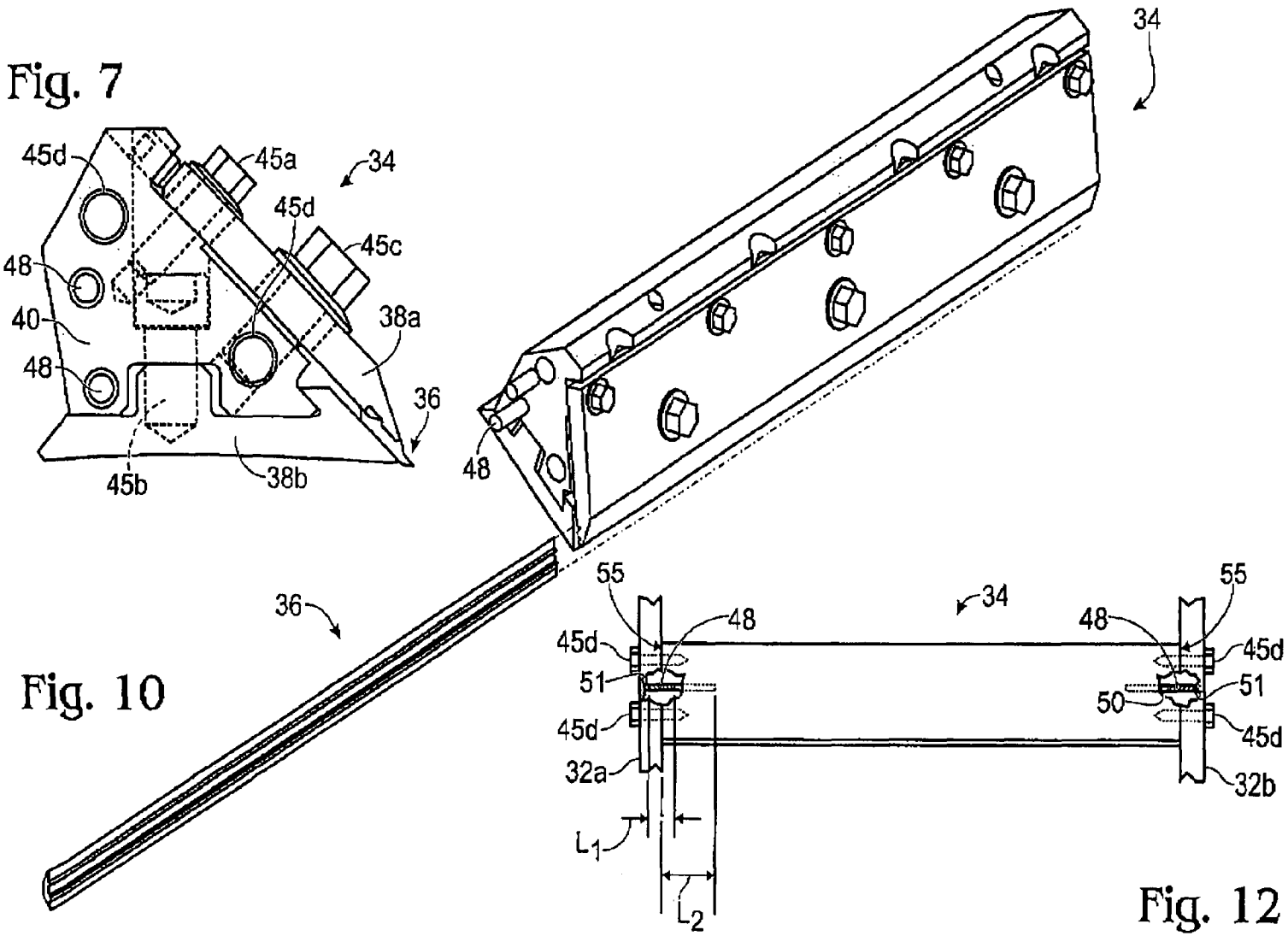
FIG. 7 is the end view of FIG. 6 showing selected phantom lines.
FIG. 10 is a pictorial view of the knife assembly of FIG. 5, showing complete removal of the knife therefrom.
FIG. 12 is a side elevation of the knife assembly of FIG. 5.
Figure 8B:
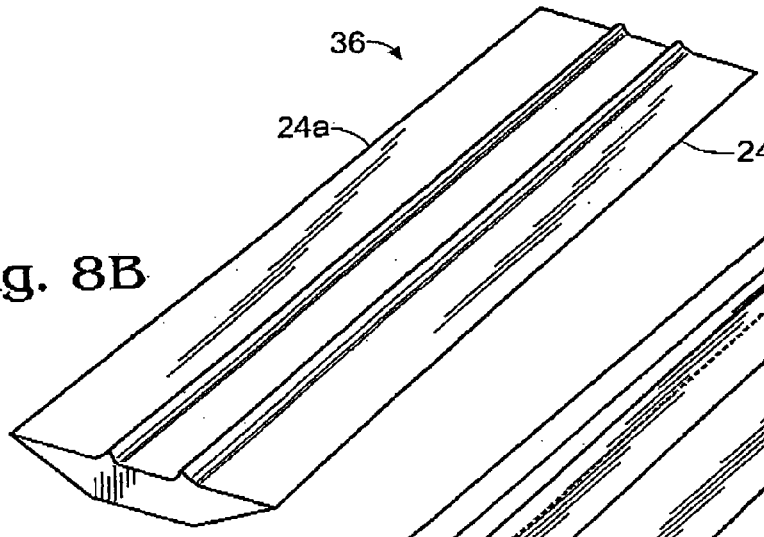
FIG. 8B is a bottom pictorial view of the knife of FIG. 9A.
Figure 8A:
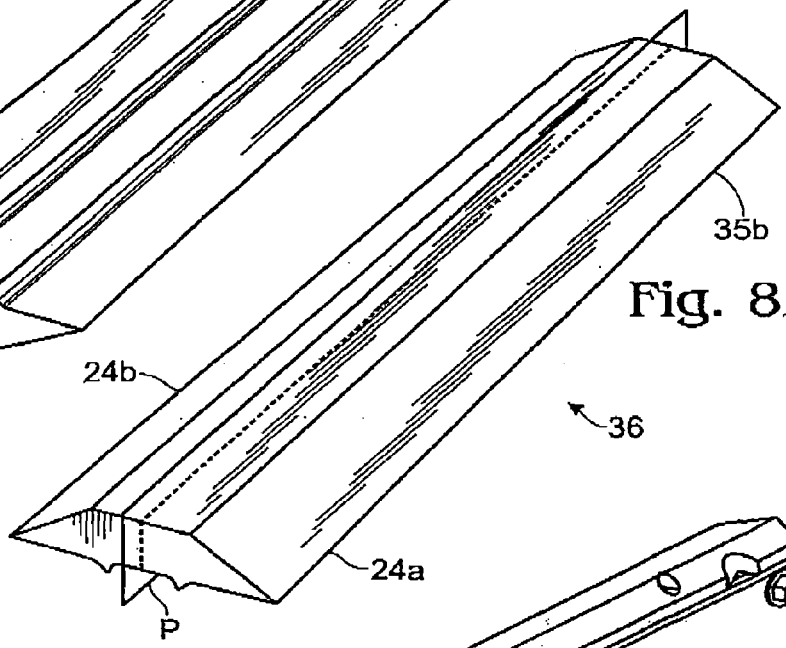
FIG. 8A is a top pictorial view of a knife for use in the knife assembly of FIG. 5.

FIGS. 5 and 6 show a knife assembly 34 according to the present invention. The knife assembly includes a knife 36, a clamp 38 and a base 40. The clamp 38 includes an upper clamping member 38*a* and a wearshoe 38*b* that functions as a lower clamping member. Both the wearshoe and the upper clamping member are bolted to the base such as shown in FIG. 7. A preferred knife 36 for use in the knife assembly 34 is also shown in FIGS. 8A and 8B.

The knife 36 is clamped to the base 40 by the clamp 38. Particularly, the knife is held between the upper clamping member 38*a* and the wearshoe 38*b*. The upper clamping member is bolted to the base 40 by use of a bolt 45*a*, and the wearshoe is bolted to the base by use of a bolt 45*b* (FIG. 7). However, the knife is not yet held by the clamp 38 until a clamp bolt 45*c* is tightened.

Particularly, the base has a raised support portion 42 (FIG. 6) on which one end of the upper clamping member 38*a* is supported. The upper clamping member is cantilevered out from this support and without any deflection is spaced apart from the wearshoe by a distance "d" that is greater than the thickness "t" of the knife. Tightening the clamp bolt 45*c* therefore deflects the cantilevered upper clamping member 38 elastically so as to bring it into contact with the knife, and further tightening of the clamp bolt tightens the clamp. Accordingly, loosening the clamp bolt 45*c* releases the clamping force on the knife and the upper clamping member relaxes its elastic deflection, freeing the knife for easy removal from the knife assembly 34. The cantilever arrangement of the upper clamping member provides the outstanding advantage, as compared to prior art spring-clamp mechanisms, of being unaffected by packing and manufacturing tolerance. This is because the cantilever can be deflected despite any cut wood fibers caught between the upper clamping member and the base, and because the entire upper clamping member functions as a single spring, the characteristics of which do not have to cooperate with those of any other springs.

Preferably, there is about a 0.004" to 0.008" clearance between the upper clamping member 38 and the knife when the clamp bolt 45*c* is fully loosened and, therefore, the upper clamping member 38 is in its relaxed, undeflected, state. Multiple instances of the clamp bolt 45*c* are preferably provided such as shown in FIG. 5 to ensure that the required clamping force can be exerted and maintained.

The wearshoe 38*b* and the base 40 advantageously include cooperatively interlocking portions 41 and 43 respectively, that function to index, strengthen and secure the attachment of the wearshoe to the base. Particularly, the interlocking portions 41 and 43 prevent movement of the wearshoe with respect to the base in the direction indicated as "A," and thereby ensure that the distance "d" is and remains fixed.

Figure 9:
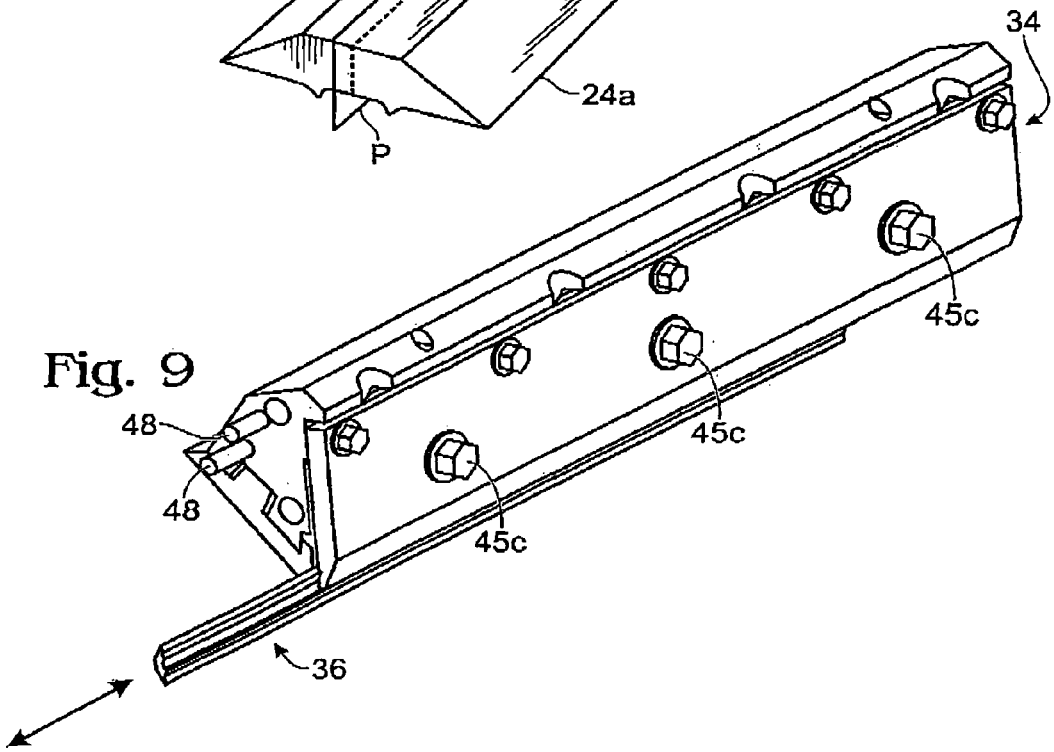
FIG. 9 is a pictorial view of the knife assembly of FIG. 5, showing partial removal of the knife therefrom.
Figure 11:
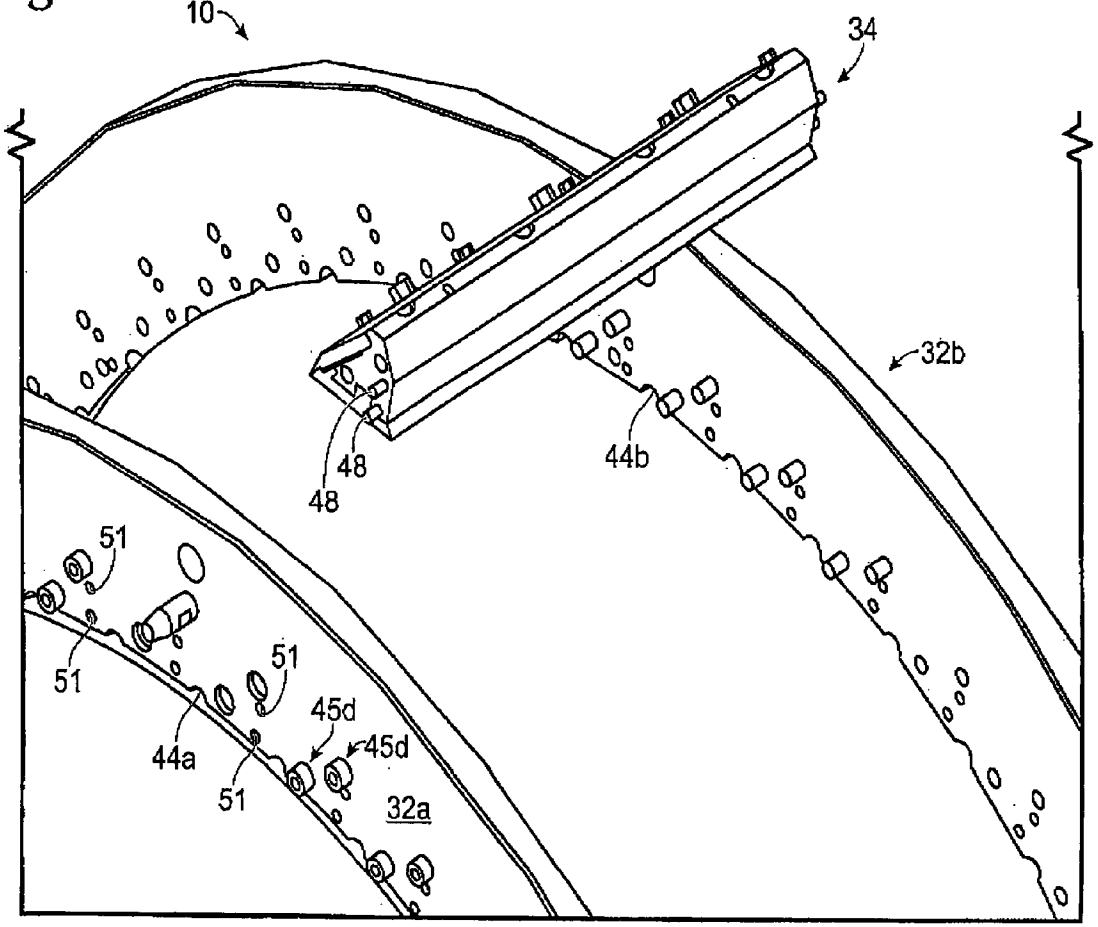
FIG. 11 is a pictorial view of a portion of the ring assembly of FIG. 4, showing removal of the knife assembly therefrom.

Referring to FIGS. 9 and 10, the knife 36, once unclamped by loosening the clamp bolt(s) 45*c*, can be installed into or removed from the knife assembly 34 in the direction of the arrows. Turning back to FIG. 4, these operations can be accomplished while the knife assembly is still in place in the ring assembly 30 simply by sliding the knife axially out of the ring assembly 34 through a corresponding slot 44 (see also FIG. 11) in the end plates 32. It is an outstanding advantage of the ring assembly 30 that neither the clamp bolts nor the knife assembly needs to be removed in order to remove the knife.

Preferably, slots 44 corresponding to a particular knife assembly 34 are provided on both end plates 32*a* and 32*b* (FIG. 11), so that the knife may be conveniently removed through one a slot in one of the end plates, e.g., 32*a*, by pushing another knife into place through the corresponding slot in the other end plate. For example, a knife 36 may be pushed into the knife assembly 34 while the knife assembly is installed in the ring assembly 10 of FIG. 11 through slot 44*b* in the end plate 32*b*, which will act to push the knife already in the knife assembly 34 out the slot 44*a* of the end plate 32*a*.

Turning to another aspect of the invention, FIGS. 6, 9, 10 and 11 show dowel pins 48 extending from the base 40. Referring to FIG. 12, the dowel pins 48 are slidingly disposed in dowel holes 50 in the base and extend into or through dowel holes 51 in the end plates 32. Bolts 45*d* (see also FIG. 7) extend through the end plates 32 into holes 53 (FIG. 6) in the base to hold the ring assembly together. The dowel pins are tight-fitting in the respective dowel holes, but are preferably slidingly movable therein by pressing or punching the pins with hand tools. The dowel holes extend deeply enough into the base that the dowel pins may be pressed or punched into the holes and wholly contained thereby, so that outer ends 49 of the dowel pins may be substantially flush with or beneath an outer end surfaces 55 of the base. Accordingly, if the length of the dowel pins is "$L_1$," the depth of the dowel holes "$L_2$," is preferably at least as great as "$L_1$."

In the ring assembly 30, the dowel pins are ordinarily positioned to extend from the dowel holes, into or through the plates 32, to locate the base 40 to the plates 32. However, to remove the knife assembly 34 from the ring assembly, the dowel pins on at least one end of the knife assembly may be pressed or punched into the dowel holes so that the knife assembly is free to slide radially out of the ring assembly. It is an outstanding advantage of the ring assembly 30 that the knife assembly can be removed from the ring assembly simply by removing the bolts 45*d* and pressing or punching the dowel pins on at least one end of the knife assembly into their respective dowel holes.

Figure 13:
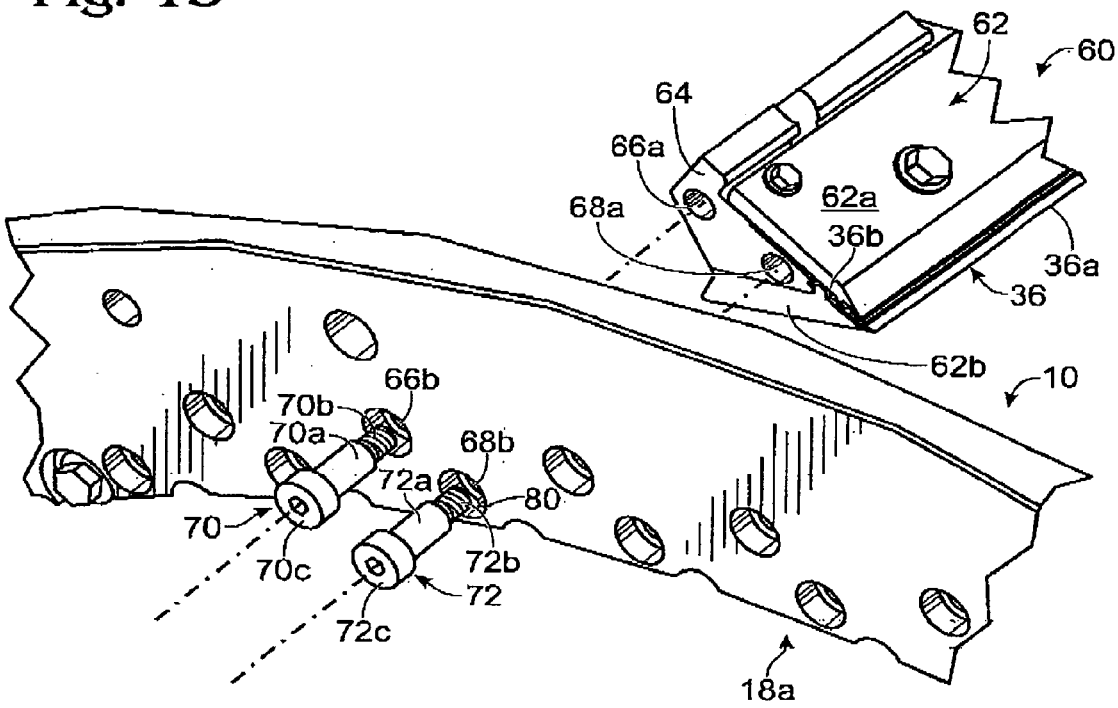
FIG. 13 is a pictorial view of a portion of an alternative ring assembly according to the present invention.
Figure 14:
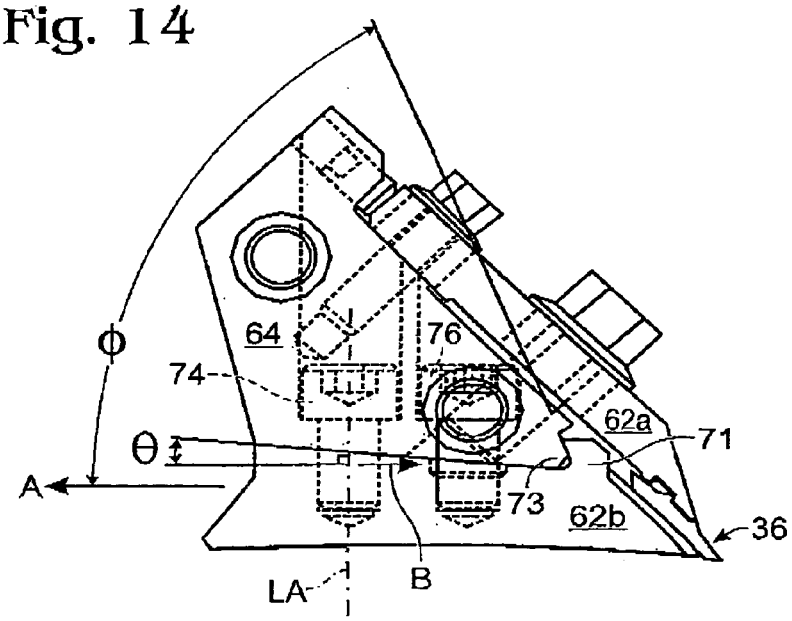
FIG. 14 is an end view of an alternative knife assembly according to the present invention.

FIG. 13 shows an alternative knife assembly 60 according to the present invention along with a portion of the ring assembly 10 to which it is to be attached. Like the knife assembly 10, the knife assembly 60 has a knife 36, a clamp 62 and a base 64. The knife 36 preferably includes dual cutting edges 36*a* and 36*b* (seen in end-view in FIG. 13). The clamp 62 includes an upper clamping member 62*a* and a wearshoe 62*b* that functions as a lower clamping member. Both the wearshoe and the upper clamping member are bolted to the base as shown in FIG. 14. The knife 36 is preferably the same as the knife described above in connection with the knife assembly 10, and the knife is preferably clamped to the base in the same manner.

The wearshoe 62*b* and the base 64 advantageously include cooperatively interlocking portions 71 and 73 respectively, that function to index, strengthen and secure the attachment of the wearshoe to the base. Particularly, the interlocking portions 71 and 73 prevent movement of the wearshoe with respect to the base in the direction indicated as "A." The cooperatively interlocking portions are preferably angled at an angle $\phi$ of about 45-60 degrees defined as shown.

In addition, the wearshoe and base include cooperatively ramping portions 75 and 77 respectively, that function to further prevent movement of the wearshoe relative to the base. Particularly, the ramping portions are oriented at an angle $\theta$ defined relative to the longitudinal axes "LA" of bolts 74 and 76 that secure the wearshoe to the base; particularly with respect to the perpendicular to these axes which in the embodiment shown is parallel to the direction "A." The angle $\theta$ is positive (defined as shown) and shallow, preferably about 5 degrees. In response to the force exerted by the bolts, the positively angled ramping portions tend to prevent movement of the wearshoe with respect to the base in the direction perpendicular to the axes "LA", which is indicated as "B."

Turning back to FIG. 13, an alternative means for attaching a knife assembly to the ring assembly 10 is shown. The ring assembly has two annular rings 18*a* and 18*b* (not shown). One end of the base 64 has at least two holes 66*a* and 68*a*, and the associated ring 18*a* has a corresponding set of holes 66*b* and 68*b*, for receiving a corresponding set of at least two shoulder bolts 70 and 72 that extend through the ring 18*a*. Preferably, corresponding sets of holes and shoulder bolts are provided at the other end of the knife assembly that is not shown.

The holes 66 and 68 provide a close tolerance clearance fit, e.g., 0.002", to shoulder portions 70*a* and 72*a* of the shoulder bolts, for aligning the knife assembly to the ring assembly. The holes 66 and 68 terminate in threaded portions (not shown) that receive the corresponding threaded portions 70*b* and 72*b* of the shoulder bolts, for bolting the knife assembly to the ring assembly. Head portions 70*c* and 72*c* of the shoulder bolts are preferably received by and seat in counterbored holes 80 in the ring 18*a*, though this not essential.

Each shoulder bolt provides the advantage of both aligning and attaching the knife assembly to the ring assembly. The two (or more) shoulder bolts together provide a greater degree of alignment and strength with less installation effort than prior art attaching means comprising separate alignment pins and bolts. While the shoulder bolts are shown for use with the knife assembly 60, they may be used in place of the dowel pins of the knife assembly 10 as well, and may be used to equal advantage in other alternative knife assemblies.

It is to be recognized that, while a particular ring slicer having an easily removable knife and knife assembly has been shown and described as preferred, other configurations and methods could be utilized, in addition to those already mentioned, without departing from the principles of the invention.

The terms and expressions which have been employed in the foregoing specification are used therein as terms of description and not of limitation, and there is no intention in the use of such terms and expressions to exclude equivalents of the features shown and described or portions thereof, it being recognized that the scope of the invention is defined and limited only by the claims which follow.

The invention claimed is:

1. An apparatus for cutting an article of wood, comprising:

a ring assembly comprising two end plates for rotation about an axis of rotation;

at least two shoulder bolts, each of said shoulder bolts having a head portion of a first diameter, a shoulder portion of a second diameter less than said first diameter, and a threaded portion having a third diameter less than said second diameter, each said shoulder portion being disposed between the corresponding head and threaded portions; and a plurality of knife assemblies, each assembly comprising an elongate knife having a cutting edge extending along an elongate axis, a clamp for clamping the knife, and a base for supporting at least a portion of said clamp, said assemblies for installation between said end plates such that the shoulder portions of said at least two shoulder bolts extend through one of said end plates into said base, the threaded portions of said shoulder bolts being received in corresponding holes in said base.

2. The apparatus of claim 1, wherein said upper clamping member is adapted for mounting to said opposite side of said base such that a first portion of said upper clamping member extends cantilevered over a corresponding portion of said wearshoe, for receiving said knife therebetween in a configuration of the apparatus in which said knife is unclamped, the apparatus being further adapted for elastically bending said upper clamping member so as force said first portion against said knife, for clamping said knife in the apparatus.

3. A knife assembly for a ring slicer, the knife assembly for mounting a knife, the knife assembly comprising:

a base;

a wearshoe;

at least one bolt for drawing said wearshoe and base together along the axis of said bolt at one side of said base, for producing a mounted configuration of said wearshoe and base in which said wearshoe is mounted to said base; and an upper clamping member for mounting engagement with said base at an opposite side of said base for clamping the knife between said upper clamping member and said wearshoe, wherein said wearshoe and said base include cooperatively interlocking portions configured to interlock in said mounted configuration so as to resist separation of said base from said wearshoe along said axis.

4. The apparatus of claim 3, wherein the knife defines an elongate axis thereof, wherein said clamping defines an orientation of the elongate axis of the knife relative to the knife assembly, and wherein said interlocking portions meet so as to define an angle $\phi$ that is inclined about 45-60 degrees with respect to a first direction, said first direction being defined in a plane perpendicular to said orientation, perpendicular to the axis of said bolt and directed away from said location.

5. The apparatus of claim 4, wherein said upper clamping member is adapted for mounting to said opposite side of said base such that a first portion of said upper clamping member extends cantilevered over a corresponding portion of said wearshoe, for receiving said knife therebetween in a configuration of the apparatus in which said knife is unclamped, the apparatus being further adapted for elastically bending said upper clamping member so as force said first portion against said knife, for clamping said knife in the apparatus.

6. The apparatus of claim 3, wherein said upper clamping member is adapted for mounting to said opposite side of said base such that a first portion of said upper clamping member extends cantilevered over a corresponding portion of said wearshoe, for receiving said knife therebetween in a configuration of the apparatus in which said knife is unclamped, the apparatus being further adapted for elastically bending said upper clamping member so as force said first portion against said knife, for clamping said knife in the apparatus.

7. A knife assembly for a ring slicer, the knife assembly for mounting a knife, the knife assembly comprising:

a base;

a wearshoe;

at least one bolt for drawing said wearshoe and base together along the axis of said bolt at one side of said base, for producing a mounted configuration of said wearshoe and base in which said wearshoe is mounted to said base; and an upper clamping member for mounting engagement with said base at an opposite side of said base for clamping the knife between said upper clamping member and said wearshoe at a location, wherein said wearshoe and said base include cooperatively ramping portions that are sloped relative to said axis so as to resist relative sliding, in said mounted configuration, of said base on said wearshoe, away from said location.

8. The apparatus of claim 7, wherein the knife defines an elongate axis thereof, wherein said clamping defines an orientation of the elongate axis of the knife relative to the knife assembly, and wherein said ramping portions are sloped so as to define an angle $\phi$ inclined about 5 degrees relative to a first direction, said first direction being defined in a plane perpendicular to said orientation, perpendicular to the axis of said bolt and directed away from said location.

9. The apparatus of claim 8, wherein said base and wearshoe include cooperatively interlocking portions configured to interlock in said mounted configuration so as to resist separation of said base from said wearshoe along the axis of said bolt.

10. The apparatus of claim 9, wherein said interlocking portions meet so as to define an angle $\phi$ that is inclined about 45-60 degrees with respect to said first direction.

11. The apparatus of claim 10, wherein said upper clamping member is adapted for mounting to said opposite side of said base such that a first portion of said upper clamping member extends cantilevered over a corresponding portion of said wearshoe, for receiving said knife therebetween in a configuration of the apparatus in which said knife is unclamped, the apparatus being further adapted for elastically bending said upper clamping member so as force said first portion against said knife, for clamping said knife in the apparatus.

12. The apparatus of claim 9, wherein said upper clamping member is adapted for mounting to said opposite side of said base such that a first portion of said upper clamping member extends cantilevered over a corresponding portion of said wearshoe, for receiving said knife therebetween in a configuration of the apparatus in which said knife is unclamped, the apparatus being further adapted for elastically bending said upper clamping member so as force said first portion against said knife, for clamping said knife in the apparatus.

13. The apparatus of claim 8, wherein said upper clamping member is adapted for mounting to said opposite side of said base such that a first portion of said upper clamping member extends cantilevered over a corresponding portion of said wearshoe, for receiving said knife therebetween in a configuration of the apparatus in which said knife is unclamped, the apparatus being further adapted for elastically bending said upper clamping member so as force said first portion against said knife, for clamping said knife in the apparatus.

14. The apparatus of claim 7, wherein said base and wearshoe include cooperatively interlocking portions configured to interlock in said mounted configuration so as to resist separation of said base from said wearshoe along the axis of said bolt.

15. The apparatus of claim 14, wherein the knife defines an elongate axis thereof, wherein said clamping defines an orientation of the elongate axis of the knife relative to the knife assembly, and wherein said interlocking portions meet so as to define an angle $\phi$ that is inclined about 45-60 degrees with respect to a first direction, said first direction being defined in a plane perpendicular to said orientation, perpendicular to the axis of said bolt and directed away from said location.

16. The apparatus of claim 15, wherein said upper clamping member is adapted for mounting to said opposite side of said base such that a first portion of said upper clamping member extends cantilevered over a corresponding portion of said wearshoe, for receiving said knife therebetween in a configuration of the apparatus in which said knife is unclamped, the apparatus being further adapted for elastically bending said upper clamping member so as force said first portion against said knife, for clamping said knife in the apparatus.

17. The apparatus of claim 14, wherein said upper clamping member is adapted for mounting to said opposite side of said base such that a first portion of said upper clamping member extends cantilevered over a corresponding portion of said wearshoe, for receiving said knife therebetween in a configuration of the apparatus in which said knife is unclamped, the apparatus being further adapted for elastically bending said upper clamping member so as force said first portion against said knife, for clamping said knife in the apparatus.

18. The apparatus of claim 7, wherein said upper clamping member is adapted for mounting to said opposite side of said base such that a first portion of said upper clamping member extends cantilevered over a corresponding portion of said wearshoe, for receiving said knife therebetween in a configuration of the apparatus in which said knife is unclamped, the apparatus being further adapted for elastically bending said upper clamping member so as force said first portion against said knife, for clamping said knife in the apparatus.

* * * * *